US010863779B2

(12) United States Patent
Guarnaschelli et al.

(10) Patent No.: US 10,863,779 B2
(45) Date of Patent: Dec. 15, 2020

(54) BREAST CANCER POST TREATMENT SUPPORT GARMENT

(71) Applicant: Jessica Guarnaschelli, Cincinnati, OH (US)

(72) Inventors: Jessica Guarnaschelli, Cincinnati, OH (US); Dana Reinisch, Los Angeles, CA (US)

(73) Assignee: JNG International LLC, Cincinnati, OH (US)

( * ) Notice: Subject to any disclaimer, the term of this patent is extended or adjusted under 35 U.S.C. 154(b) by 0 days.

(21) Appl. No.: 16/251,803

(22) Filed: Jan. 18, 2019

(65) Prior Publication Data

US 2019/0159527 A1 May 30, 2019

Related U.S. Application Data

(63) Continuation-in-part of application No. 15/653,174, filed on Jul. 18, 2017, now abandoned.

(60) Provisional application No. 62/363,571, filed on Jul. 18, 2016.

(51) Int. Cl.
*A41C 3/00* (2006.01)
*A41C 3/10* (2006.01)

(52) U.S. Cl.
CPC ..... *A41C 3/0064* (2013.01); *A41C 3/0014* (2013.01); *A41C 3/10* (2013.01); *A41C 3/0035* (2013.01); *A41C 3/0085* (2013.01)

(58) Field of Classification Search
CPC ..... A41D 13/1245; A41C 3/00; A41C 3/03; A41C 3/0064; A41C 3/0028; A41C 3/10; A41C 3/14
USPC ..... 450/37, 36, 86, 54–57, 58
See application file for complete search history.

(56) References Cited

U.S. PATENT DOCUMENTS 2,522,010 A * 9/1950 Woodruff ..... A41C 3/04 450/36
2,679,048 A * 5/1954 Alberts ..... A41C 3/0021 450/36
4,369,792 A * 1/1983 Miller ..... A41C 3/148 450/55

(Continued)

OTHER PUBLICATIONS

U.S. Patent and Trademark Office, Office Action issued in U.S. Appl. No. 15/653,174 dated Sep. 26, 2018, 9 pages.

*Primary Examiner* — Gloria M Hale
(74) *Attorney, Agent, or Firm* — Ulmer & Berne LLP

(57) ABSTRACT

The invention is related to support garment for breast cancer patients who have undergone or are going through radiation therapy after lumpectomy, mastectomy, or breast reconstruction. This garment will reduce skin on skin irritation, material on skin chaffing inside/out, or radiation therapy induced edema. Additionally, it will provide medium to high support. It will provide a coated material to prevent staining from radiation creams/skin gels. Lastly, it will provide comfort with material based cut-outs for added breathability and cooling. The support garment will include a separate inner most cup fabric coated to provide pocket for prosthetic breast forms, and a lower support area with printed silicone flocked standoff texture to reduce chaffing inside & out. It is easy "get on" and "take off" for patients with arm mobility issues. The design will be flattering & beautiful to wear for these patients.

14 Claims, 6 Drawing Sheets

(56) References Cited

U.S. PATENT DOCUMENTS

| | | | | |
|---|---|---|---|---|
| 2009/0325464 | A1* | 12/2009 | Dekoster | A41F 15/02 450/86 |
| 2013/0232661 | A1* | 9/2013 | Huntley | A41C 3/08 2/104 |
| 2015/0071978 | A1* | 3/2015 | Chang | A61N 2/06 424/402 |
| 2017/0265530 | A1* | 9/2017 | Donlon | A41F 15/002 |

* cited by examiner

BREAST CANCER POST TREATMENT SUPPORT GARMENT

CROSS-REFERENCE TO RELATED APPLICATIONS

This application is a continuation-in-part of U.S. Non-provisional application Ser. No. 15/653,174, filed Jul. 18, 2017, now abandoned, which in turn claims the benefit of U.S. Provisional Application No. 62/363,571, filed Jul. 18, 2016, the disclosures of which are incorporated herein by reference in their entirety.

FIELD OF THE INVENTION

This invention relates to post-surgery and radiation treatment breast support garments and, more specifically, breast support garments for use during or after breast cancer treatments involving radiation therapy.

BACKGROUND OF THE INVENTION

Breast cancer treatments often have deleterious effects on the body. Often, patients will endure radiation skin peeling, discomfort, and swelling around and within the breast tissue. Patients may have radiation "burns" beneath or around the breast and within the axilla. Also, they may have soreness, irritation, peeling, and burning of the nipple and areola. Finally, patients may have lasting heaviness and soreness of the breast from acute and chronic swelling, which may last from 6 weeks to 5 years after radiation treatment.

Bras, camisoles, and related garments have been designed to increase comfort, ease of use, and function to a person who is battling cancer. However, in general, the available garments have not kept pace with advancements in breast cancer treatment technologies and practices. Due to advances in surgery and radiation, treatment techniques and early detection, more and more women are being treated with lumpectomy and radiation therapy instead of a mastectomy. Radiation therapy typically causes significant irritation of the skin in the treated area, which is much akin to a sunburn. The skin may feel raw, blistered, tender, and sensitive to touch, rubbing, movement, or stretching.

SUMMARY

To address the drawbacks above, embodiments of the present invention are directed to improved post-radiation therapy breast support garments that emphasize comfort against the skin of a wearer while providing functional support in the breast region.

In an embodiment, a garment for a wearer having breasts and an under bust located directly under the breasts includes a band configured to fit at the under bust of the wearer, a cup extending from the band, a head opening, and first and second arm openings. The cup includes an outer layer, an inner layer that is interior to the outer layer, and an attachment component configured to removably couple an insert to the inner layer. When the insert is coupled to the inner layer, at least a portion of the insert is exposed to the skin.

BRIEF DESCRIPTION OF THE DRAWINGS

The accompanying drawings, which are incorporated in and constitute a part of this specification, illustrate embodiments of the invention and, together with a general description of the invention given above and the detailed description given below, serve to explain the invention.

DETAILED DESCRIPTION

Figure 1:
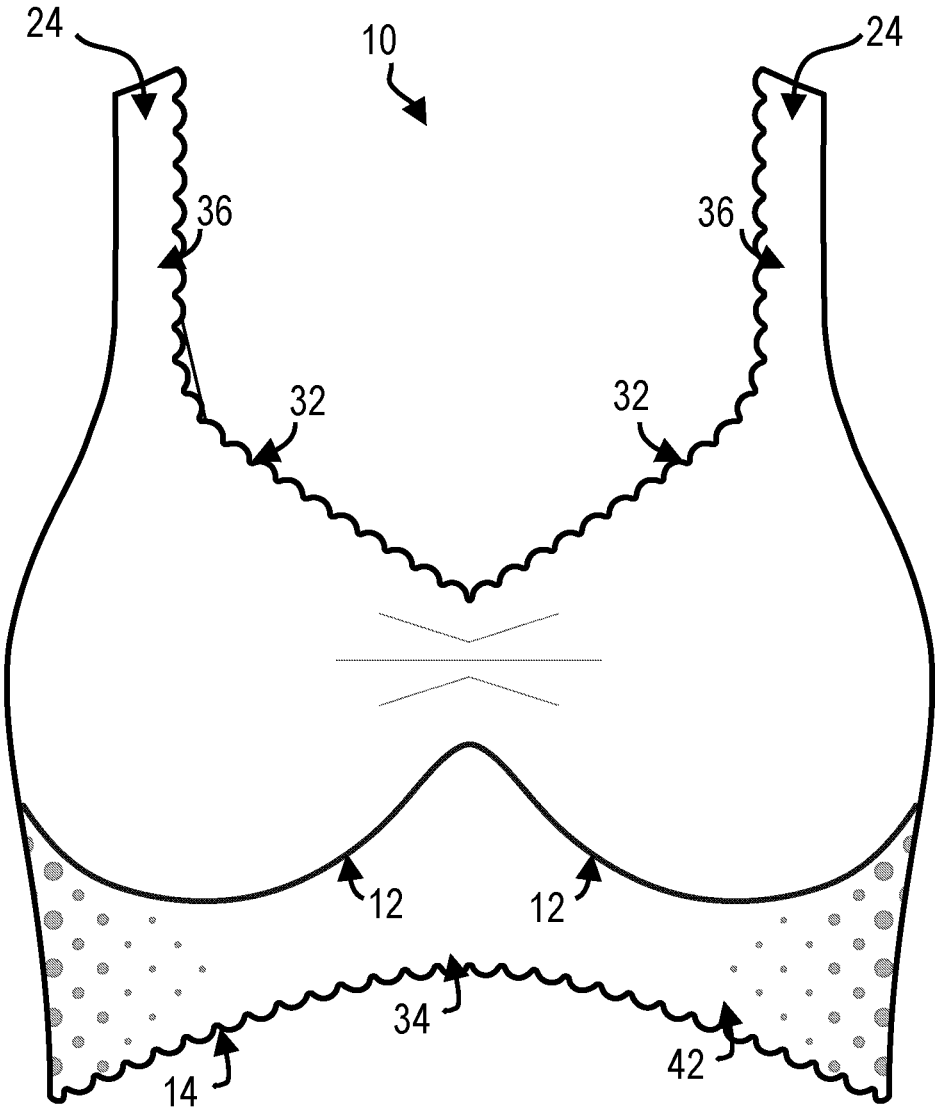
FIG. 1 is a front view of a post-treatment garment according to an embodiment of the invention.
Figure 2:
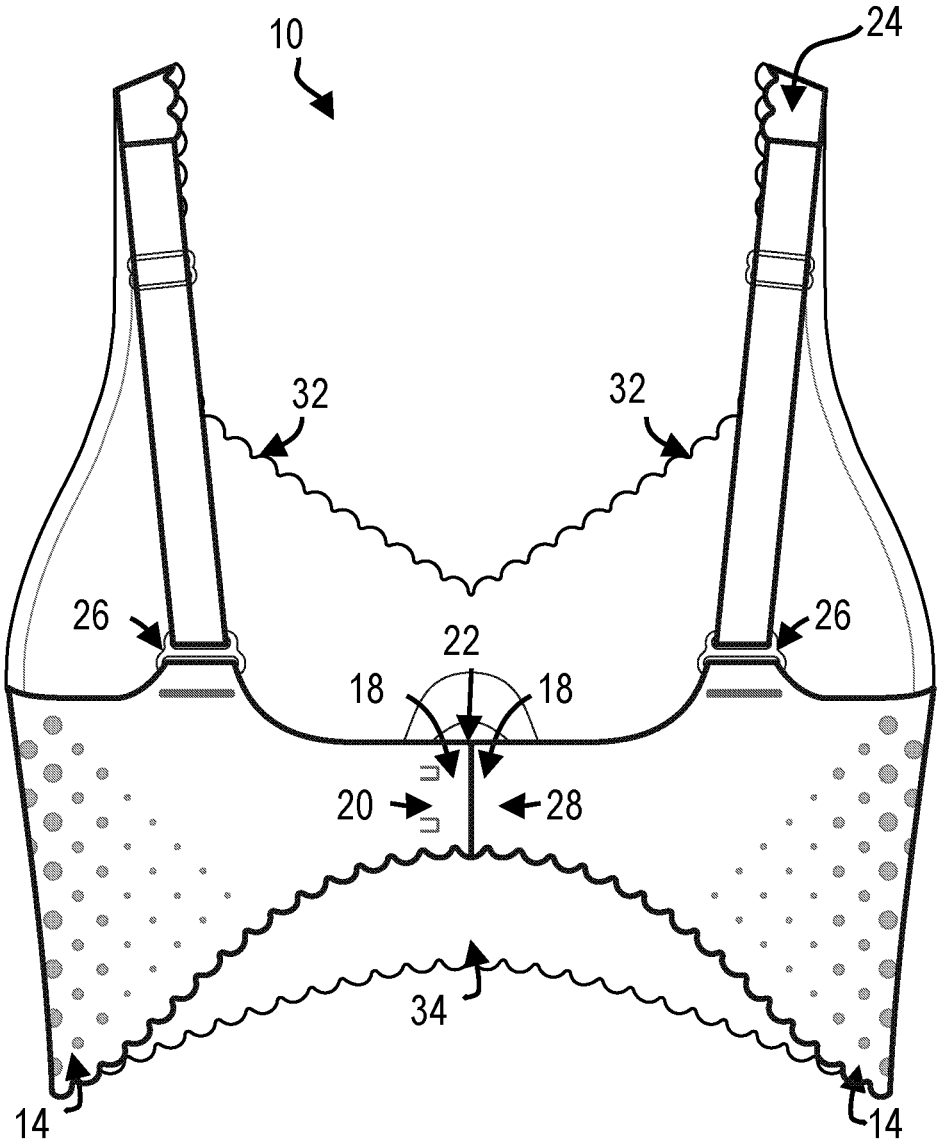
FIG. 2 is a back view of the post-treatment garment of FIG. 2.

With reference to FIGS. 1 and 2, in an embodiment, a post-treatment breast support garment 10 is shown having a head opening and first and second arm openings. The garment 10 includes two cups 12 with ultrasonic welded, cut & sealed edges with foam for supporting the wearer's breasts. Coupled to the cups 12 is a band 14 that extends around a wearer's torso below the bust. The cups 12 may be sewn into the band 14, made of screen-printed silicone flocked standoff texture to reduce chaffing inside & out may. When worn, the bottom of the cups 12 may rest against the inframammary fold of the breast. For example, the inframammary fold may be about 2 cm lower than the most inferior part of the breast that is flat against the chest wall. The garment 10 will include a soft bonded-in fabric creating a soft under wire & attaches the molded cups 12 to the chest band 14 with a pocket to secure a prosthesis with a separate inner most cup fabric coated to provide pocket for prosthetic breast forms that will be bonded in perimeter only. (e.g., between the inner layer and outer layer described below). The garment 10 has a rear closure 16, with a seamlessly integrated one hook & eye with four rows which helps ease any shoulder discomfort that may be present after treatment. The rear closure 16 includes two strips 18 that each extend from the cup 12 towards the bottom of the band 14. Each strip 18 includes a row of closure elements. In the illustrated embodiment, the closure elements include a hook on one of the strips 18 and a corresponding eye with four rows 22 on the other of the strips 18. The hooks 20 may be inserted into the eyelets 22 to secure the garment 10 around the wearer. The rear closure 16 further includes a flap 23 positioned between the closure elements and the skin. The flap 23 prevents the hooks 20 and eyelets 22 from contacting the skin. While the illustrated embodiment depicts a rear closure, it should be recognized that the garment 10 may include a front closure. The garment 10 further includes two straps 24 that are coupled to the top of the cups 12 via hooks 26. The straps 24 extend from the top of the cups 12, over the wearer's shoulders, and towards the back of the band 14. The straps 24 are relatively wide (e.g., compared to an average bra strap width) to disperse the load. The length of the straps 24 may be adjustable.

Figure 3:
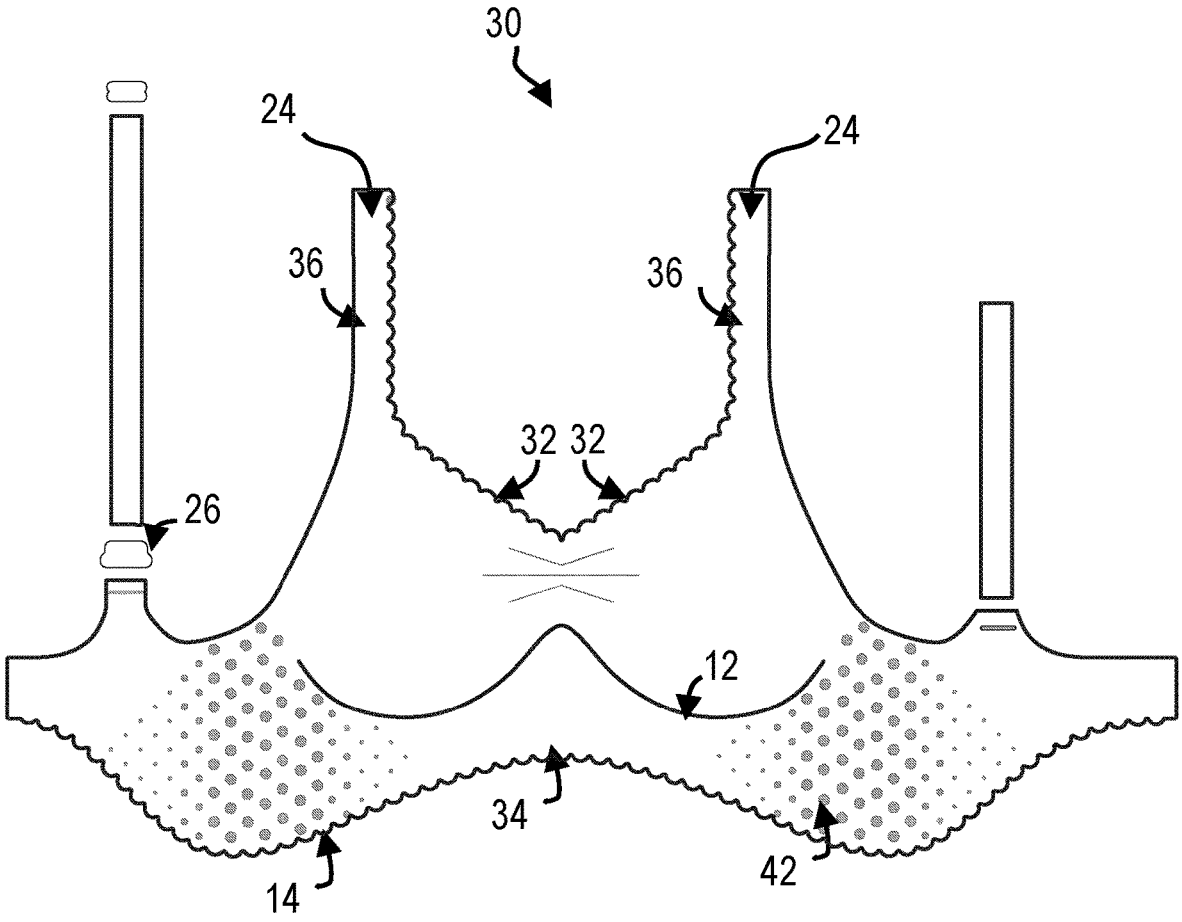
FIG. 3 is a front view of a post-treatment garment according to an embodiment of the invention.
Figure 4:
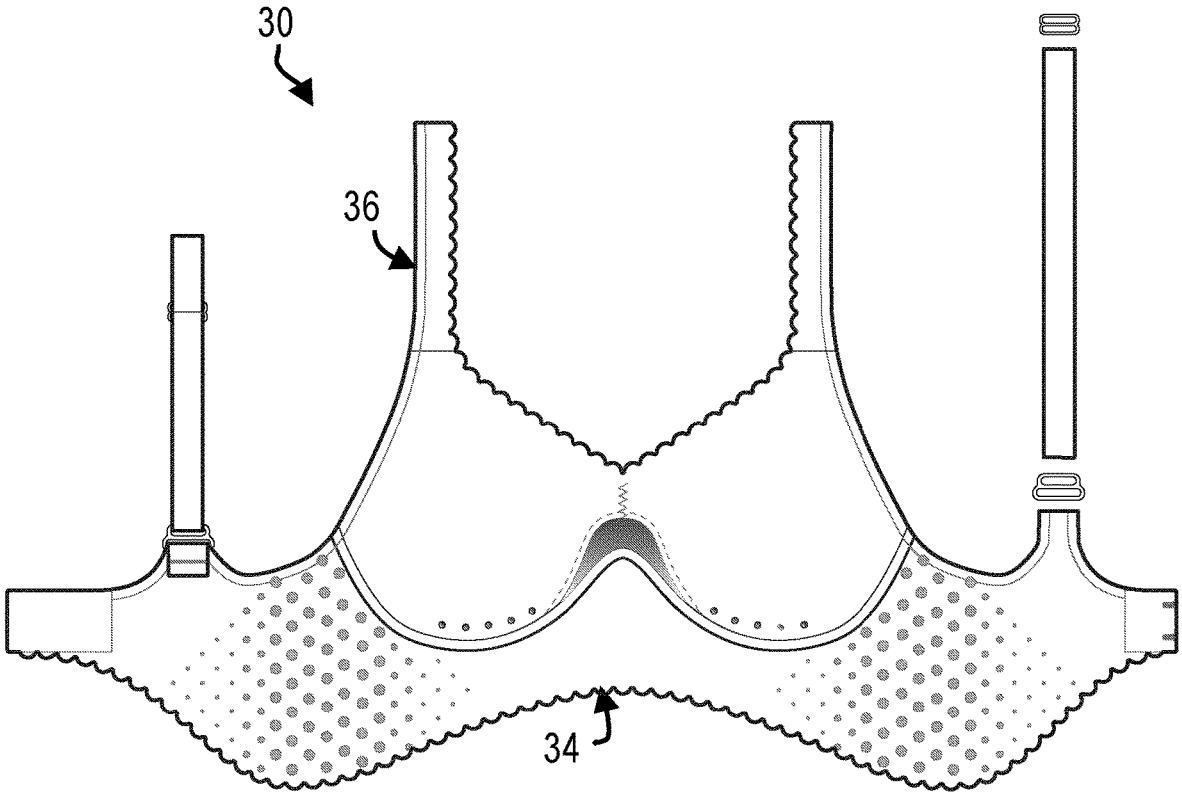
FIG. 4 is a back view of the post-treatment garment of FIG. 3.

With reference to FIGS. 3 and 4, in an embodiment, a post-treatment breast support garment 30 is shown having a head opening and first and second arm openings. Similar to the garment 10, the garment 30 includes two cups 32 for supporting the wearer's breasts. Coupled to the cups 32 is a band 34 that extends around the wearer's torso below the bust. The garment 30 further includes straps 36 that are integrally formed with the cups 32. The straps 36 extend over the shoulders of the wearer and form a racer-back shape. It should be recognized that the straps may be made in a shape other than T-shape or racer-back as long as the straps are wide enough to provide adequate support to the cups. Like the garment 10, the garment 30 has a rear hook-and-eye closure 38, which includes hooks 20, eyelets 22, and the flap 23.

Figure 5:
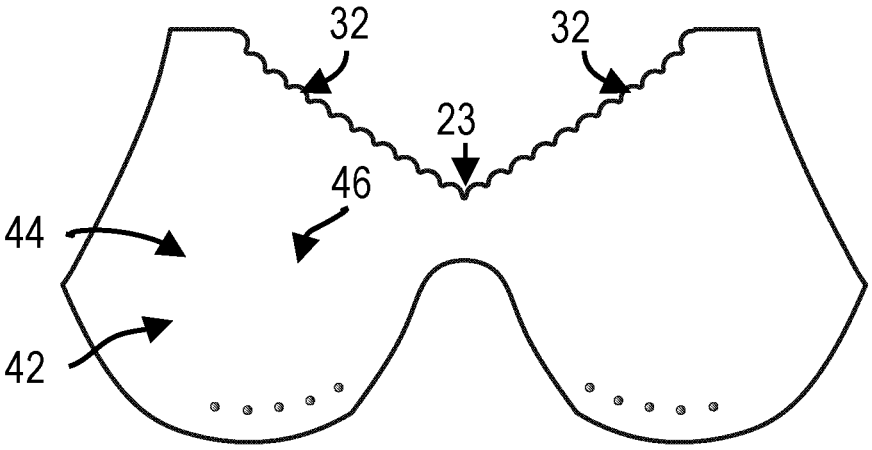
FIG. 5 is a partial cross-sectional view of the post-treatment garment of FIG. 3.
Figure 6:
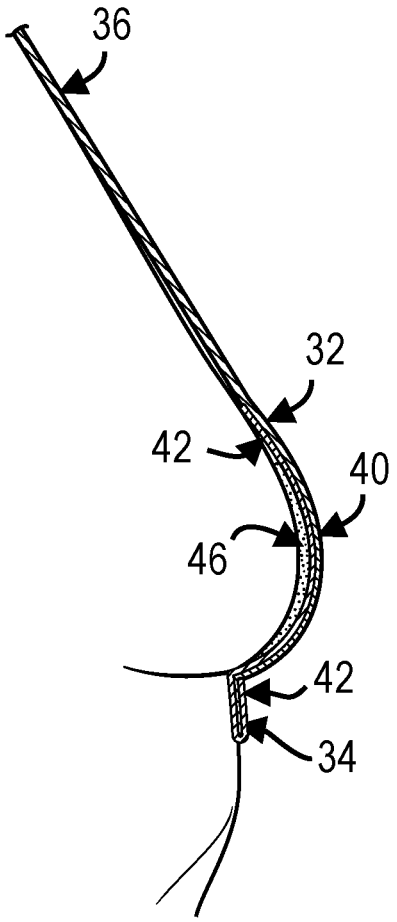
FIG. 6 is a cross-sectional view of the post-treatment garment of FIG. 3.

Referring now to FIGS. 5 and 6, the garment 30 of FIGS. 3 and 4 is shown in more detail. However, these features equally apply to the garment 10 of FIGS. 1 and 2. The cups 32 include an outer layer 40, which may be the same as the material used to form the straps 36 and/or the band 34. The material forming the band 34, straps 36, and outer layer 40 of the cups 32 should be soft, able to wick moisture away from the skin, and elastic so the garment 30 stretches with the movements of the wearer. Further, the material may be hypoallergenic to reduce the likelihood of irritating the skin and include holes cut out by laser or die cut in the coated fabric for breathability and moisture management. The material may include, for example, about 70-80% bamboo viscose, about 10-30% polyamide, and about 5-20% elastane. Other exemplary materials include organic cotton, spandex, and satin. The cups 32 further include an inner layer 42 that is soft to avoid irritating the sensitive skin affected during treatment. For example, the inner layer 42 may be made of satin or ribbed microtexture fabric that reduces chafing of the irradiated skin. The garment 30 may be configured to reduce chafing at the axilla and along the band 34. For example, the soft inner layer 42 may extend from the inside of the cups 32 along an inner surface of the band 34 and fold out above an outer surface of the band 34 (shown in FIGS. 3 and 6). For example, the folded material may cover portions of the outer surface of the band 34 that are likely to be in contact with skin (e.g., the axilla, arm). An edge of the folded material from layer 42 may extend along the outer surface of the band 34 to a bottom edge of the cups 32 to act as a soft underwire.

Still referring to FIGS. 5 and 6, an insert layer 46 may be removably coupled to each of the cups 32. For example, the insert layers 46 may be removably coupled to the inner layer 42 via an attachment component. In the illustrated embodiment, the attachment component includes a plurality of threads 44 or strings that are attached to the inner layer 42. Corners of the insert 46 may be positioned between the threads 44 and the inner layer 42. When each of the corners is held by a thread 44, the insert 46 is secured to the garment 30. The insert 46 may be made of, for example, a hydrogel. The hydrogel may be a medical grade silicone, such as a LilyPadz silicone pad available from Me & My Kidz, LLC. At least a portion of the insert 46 is exposed so that, when worn, the insert 46 is in contact with the skin. For example, the insert 46 may be in contact with the nipple, areola, and/or axilla area of the breast to ease any discomfort (e.g., burning, peeling, etc.) caused by the treatment. The insert 46 provides less irritation to the irradiated skin compared to the material of the inner layer 42.

It should be recognized that embodiments of the present invention may include other features. For example, while the garments 10, 30 are not illustrated with lace or other ornamentation, such ornamentation may be included. Further, a garment may include a netting that could hold treatment creams against the skin. Alternatively, a wearer may place a treatment cream on the insert, inner layer, or more generally on the cup. Further, while the garments 10, 30 are each illustrated as a bra, it will be recognized that embodiments of the present invention may be directed to other garments including, for example, a camisole, an exercise top, a swim top, or a garment to be worn under sleepwear.

While specific embodiments have been described in considerable detail to illustrate the present invention, the description is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details or representative illustrative examples shown and described. Accordingly, departures may be made from such details without departing from the scope of the general inventive concept.

What is claimed is:

1. A garment for a wearer having breasts and an under bust located directly under the breasts, comprising:
- a band configured to fit at the under bust of the wearer;
- a cup extending from the band comprising:
  - an outer layer;
  - an inner layer that is interior to the outer layer, the inner layer being made of screen printed silicone flocked standoff texture; and
  - an attachment component configured to removably couple an insert to the inner layer;
- a head opening; and
- first and second arm openings;
- wherein, when a bra form insert is coupled to the inner layer, at least a portion of the bra form insert is exposed to skin of the wearer.

2. The garment of claim 1, wherein the band and the outer layer are made of hypoallergenic fabric.

3. The garment of claim 2, wherein the outer layer further comprises about 10-30% polyamide and about 5-20% elastane.

4. The garment of claim 1, wherein the inner layer includes one opening for the bra form insert.

5. The garment of claim 1, wherein the inner layer is made of coated fabric, bonded about a perimeter of each cup and defining a pocket for a prosthetic breast form.

6. The garment of claim 5, wherein the inner layer contains laser or die cut holes in the coated fabric.

7. The garment of claim 1, wherein the outer layer is made of body fabric, foam spray glued to the inner layer and molded and bonded together in a two-part male and female mold.

8. The garment of claim 1, wherein a bottom edge of the cup connects to the inner layer.

9. The garment of claim 1, further comprising a support strap, wherein the support strap extends from a top of the cup, consists of foam, and is ultrasonically welded, cut, and has sealed edges.

10. The garment of claim 1, wherein the inner layer is made of a material selected from the group consisting of satin and ribbed microtexture fabric.

11. The garment of claim 1, wherein the outer layer is foam spray glued to the inner layer.

12. The garment of claim 1, wherein the garment contains laser or die cut holes.

13. The garment of claim 1, further comprising the bra form insert.

14. The garment of claim 5, further comprising a prosthetic breast form.

* * * * *